United States Patent [19]

Isozumi

[11] Patent Number: 5,076,109

[45] Date of Patent: Dec. 31, 1991

[54] STARTER MOTOR

[75] Inventor: Shuzou Isozumi, Himeji, Japan

[73] Assignee: Mitsubishi Denki Kabushiki Kaisha, Tokyo, Japan

[21] Appl. No.: 605,331

[22] Filed: Oct. 30, 1990

[30] Foreign Application Priority Data

Nov. 1, 1989 [JP] Japan ..... 1-286196

[51] Int. Cl.[5] ..... F02N 15/06

[52] U.S. Cl. ..... 74/7 A; 74/7 E; 74/7 C

[58] Field of Search ..... 74/6, 7 R, 7 A, 7 E, 74/7 C; 123/179 M; 290/38 C, 48

[56] References Cited

U.S. PATENT DOCUMENTS 4,440,033 4/1984 Kurihara et al. .
4,800,766 1/1989 Isozumi et al. .
4,808,836 2/1989 Isozumi et al. .

FOREIGN PATENT DOCUMENTS 63-90665 4/1988 Japan .

OTHER PUBLICATIONS

Mitsubishi Denki K.K., Japanese printed patent application #1-252082, printed Aug. 10, 1990.

*Primary Examiner*—Allan D. Herrmann
*Attorney, Agent, or Firm*—Sughrue, Mion, Zinn, Macpeak and Seas

[57] ABSTRACT

A starter motor comprising a pinion (3) which engages at an inner circumference of a gear portion thereof with an outer circumference of an output rotary shaft (4), and a cylindrical member (15) integrally disposed behind the pinion. A front end portion of a clutch inner member (9b) of an over-running clutch unit (9) is in sliding abutment with an outer circumferential surface of the cylindrical member, and the inner circumferential surface of the cylinder member is in splined engagement with the output rotary shaft.

2 Claims, 2 Drawing Sheets

STARTER MOTOR

BACKGROUND OF THE INVENTION

This invention relates to a starter motor mainly used as a vehicular engine starter motor.

FIG. 2 is a partial sectional view illustrating a conventional stater motor disclosed in Japanese Patent Laid-Open No. 63-90665 for example. This starter motor is a coaxial starter motor in which an armature rotary shaft 2 of a d.c. motor 1, an output rotary shaft 4 having a pinion 3 at its front end portion (right end portion in the figure) and a solenoid switch unit (not shown) are arranged on the same axis. That is, the arrangement is such that the armature rotary shaft 2 is hollow, the plunger rod 5 of the solenoid switch unit disposed behind the d.c. motor 1 is inserted into an inner passage 2*a* of the armature rotary shaft 2, and the output rotary shaft 4 is disposed at the front end side of the inner passage 2*a* and the plunger rod 5 is brought into abutment with the rear end face through a steel ball 6, so that the output rotary shaft 4 can be pushed forward by the forward movement of the plunger rod 5.

Also, at the front end of the armature rotary shaft 2, a sun gear 7*a* of a planetary speed reduction gear 7 is formed. The planetary speed reduction gear 7 comprises the sun gear 7*a*, an inner gear 7*b* formed in an inner circumferential surface of a front bracket 8 and planetary gears 7*d* rotatably supported by pivot shafts 7*c* and meshing with the sun gear 7*a* and the inner gear 7*b*.

The pivot shafts 7*c* of the planetary speed reduction gear 7 are secured to a clutch outer member 9*a* of an over-running clutch mechanism 9 so that the speed-reduced output from the armature rotary shaft 2 is transmitted to the over-running clutch mechanism 9. On the inner circumference side of the clutch outer member 9*a*, a clutch inner member 9*b* and rollers 9*c* inserted between the clutch inner and outer members are provided, constituting the over-running clutch mechanism 9. In the inner circumferential surface of the clutch inner member 9*b*, helical spline grooves 9*d* are formed which are in mesh with the helical splines 4*a* formed in an enlarged diameter portion of the output rotary shaft 4, and a return spring 10 is disposed between a step portion 9*e* on the front end of the clutch inner member and the helical splines 4*a* for rearwardly biasing the output rotary shaft 4. Further, the front end portion of the clutch inner member 9*b* is supported by a bearing 11 fitted within the front bracket 8.

The pinion 3 is spline-engaged with straight splines formed in the front end portion of the output rotary shaft 4 and its forward movement is limited by a stopper 12. Also, within a recessed portion 3*a* formed in the inner circumference portion of the pinion 3, a pinion spring 13 is disposed between it and a step portion 4*b* on the output rotary shaft 4 so that the pinion 3 is urged forward. The pinion spring 13 is provided, after the stopper 12 is assembled for, always forwardly urging the pinion 3 and moderating the shocks upon contacting of the pinion 3 against the engine ring gear. Incidentally, 14 indicates a bearing disposed within the inner passage 2*a* of the armature rotary shaft 2 for supporting the rear portion of the output rotary shaft 4.

In the coaxial starter motor constructed as above-described, the rotational drive force of the d.c. motor 1 is transmitted to the over-running clutch mechanism 9 through the planetary speed reduction gear 7 and further to the output rotary shaft 4 which is spline-engaged with the clutch inner member 9*b*. As the plunger rod 5 is driven forward, the output rotary shaft 4 is moved forward so that the pinion 3 engages the unillustrated engine ring gear to start the engine. After starting, the operator manually turns off the solenoid switch to retract the plunger rod 5 to cause the output rotary shaft 4 to be returned to the original position (inactuated position) by the action of the return spring 10, thereby to disengage the pinion 3 from the engine ring gear. Also, the reverse driving from the engine side immediately after the starting of the engine is prevented from being transmitted to the side of the d.c. motor 1 by the unidirectional-clutch action of the over-running clutch mechanism 9.

The conventional starter motor is constructed as above-described and the spring 13 for forwardly biasing the pinion 3 is disposed within the recessed portion 3*a* in the inner circumference of the pinion 3 and on the outer circumference of the output rotary shaft 4.

Generally, since the deddendum thickness t of the pinion 3 and the effective diameter of the output rotary shaft 4 are difficult to make less than a predetermined value because the they must have a predetermined strength, the minimum deddendum diameter of the pinion 3 is restricted, so that the minimum number of teeth of the pinion 3 is also determined. More specifically, in a gear configuration of the level of DP10 (Module M=2.54), for example, which is widely used in the automotive engine ring gear and the pinion 3, the minimum number of teeth of the gear was conventionally eight.

On the other hand, in the starter motor of this type, a relationship expressed by the following equation is established between the volume of the armature of the d.c. motor 1 and the gear ratio between the pinion 3 and the ring gear:

$$Da^2Lc \propto Te/g \cdot I \cdot \sqrt{\phantom{x}}$$

where, Da: outer diameter of the armature core of the d.c. electric motor; Lc: armature core length (axial length of the core); Te: engine torque; g: gear ratio; I: drive current; Rs: resistors of the starter motor. As apparent from this equation also, the volume of the armature is in inverse proportion to the gear ratio between the pinion 3 and the ring gear, so that, in a situation in which the number of teeth of the ring gear is constant and the number of teeth of the pinion 3 is difficult to decrease, a reduction in volume of the armature, i.e., miniaturization and compactness of the starter motor, has been very difficult.

Also, in the conventional starter motor, the front portion of the output rotary shaft 4 is supported by a spline-engagement portion between the helical spline grooves 9*d* of the clutch inner member 9*b* and the helical spline portion 4*a*. However, since with the helical spline engagement it is difficult to make the clearance of the engaging portion extremely small because of the requisite slidable movement therebetween, a certain play is provided between the output rotary shaft 4 and the clutch inner member 9*b*, and since the engagement portion which is a support portion is not the front end portion of the clutch inner member 8*b*, the distance between the engagement portion and the pinion 3 is large, resulting in a large bending moment. Accordingly, since the conventional starter motor has the above-mentioned play and the large bending moment, it has the problems that a noise is generated during operation and the output shaft 4 may be broken. Moreover, since the helical spline grooves 9*d* provide sliding surfaces for the output rotary sahft 4 while supporting a load, this can cause undesirably poor sliding movement of the output rotary shaft 4 if the clearance is not properly selected.

SUMMARY OF THE INVENTION

Accordingly, one object of the present invention is to provide an engine starter motor in which the above problems of the conventional starter motor have been solved.

Another object of the present invention is to provide a starter motor which can be made small and lightweight.

Another object of the present invention is to provide an engine starter motor which is free from the generation of noise and the breakage of the output rotary shaft.

A further object of the present invention is to provide an engine starter motor which is reliable.

With the above objects in view, the starter motor of the present invention comprises a pinion which engages at an inner circumference of a teeth formed portion of the pinion with an outer circumference of the output rotary shaft, and a cylindrical member integrally disposed behind the pinion, and a front end portion of the clutch inner member of an over-running clutch unit is brought into a sliding abutment relationship with an outer circumferential surface of the cylindrical member so that an inner circumferential surface of the cylinder member is in engagement with the output rotary shaft and the rotary drive force transmitting relationship.

In the present invention, the inner circumference of the pinion is in a direct sliding relationship with the output rotary shaft, and since there is no pinion spring and no spline engagement portion between the pinion and the output rotary shaft, it is possible to decrease number of teeth of the pinion while the mechanical strength of both the pinion and the output rotary shaft can be decreased. Also, since the output rotary shaft is supported by the front end portion of the clutch inner end portion by the pinion and the cylindrical member integral with the pinion, there is substantially no play between the clutch inner member and the output rotary shaft. Also, since the support portion is located in front of the helical spline engagement portion, the bending moment on the output rotary shaft is small.

BRIEF DESCRIPTION OF THE DRAWINGS

The present invention will become more readily apparent from the following detailed description of the preferred embodiments of the present invention taken inconjunction with the accompanying drawings, in which.

DESCRIPTION OF THE PREFERRED EMBODIMENT

Figure 1:
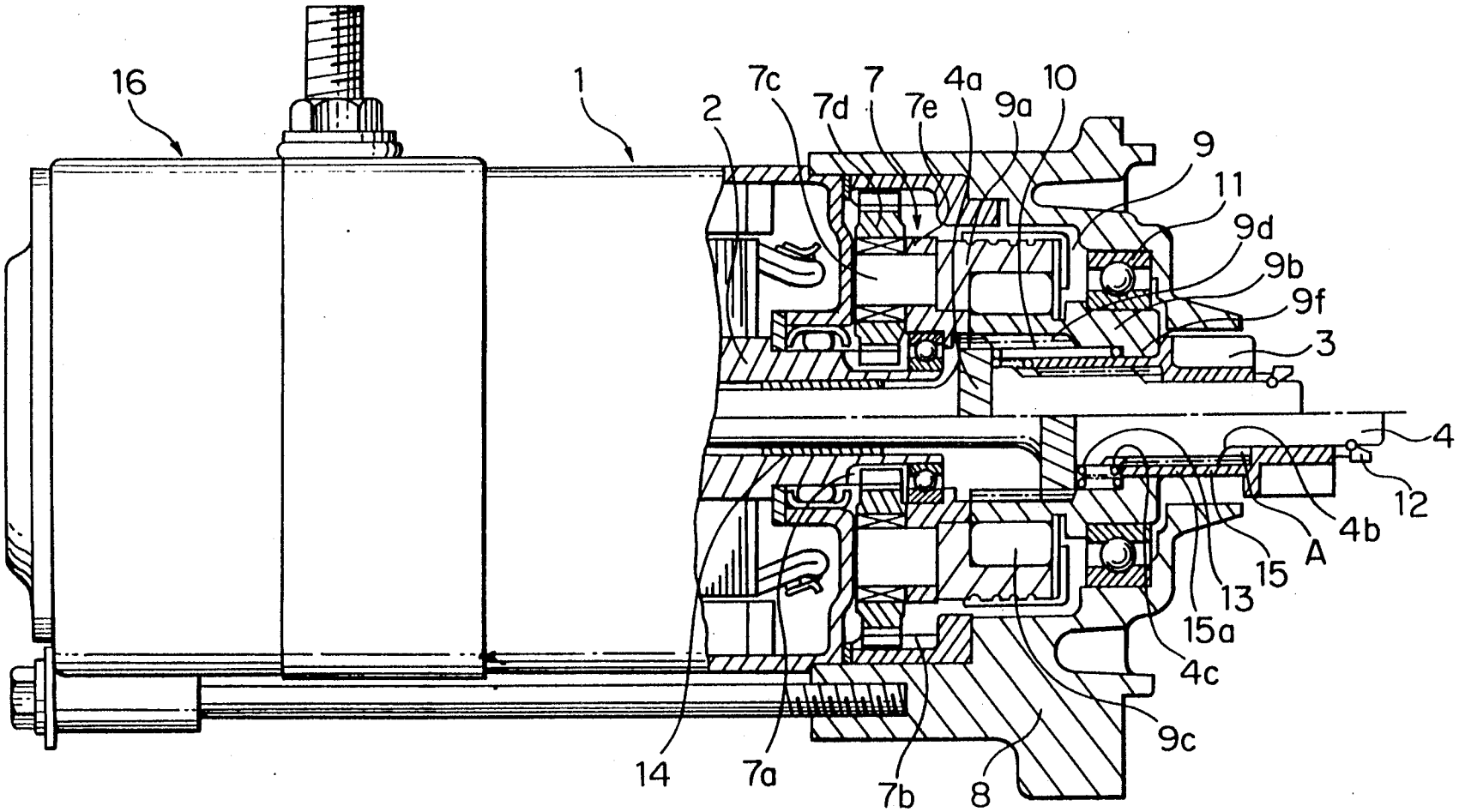
FIG. 1 is a sectional view of the main portion of the engine starter motor of one embodiment of the present invention.
Figure 2:
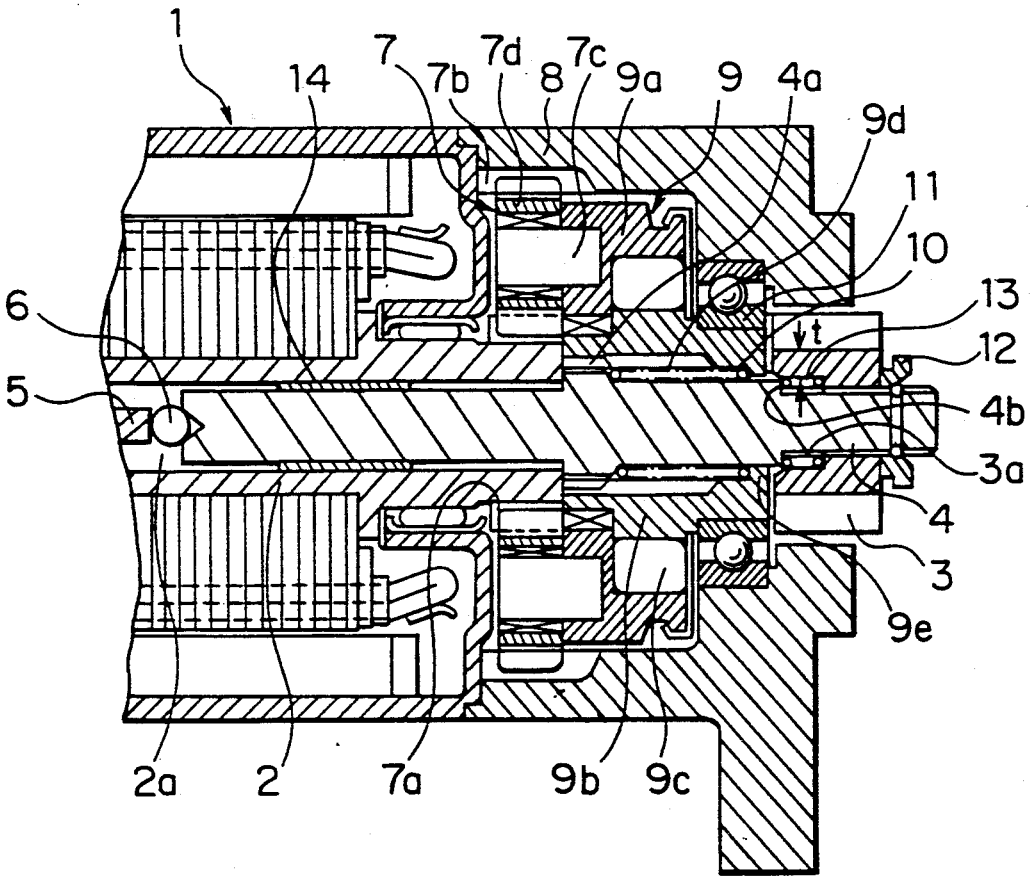
FIG. 2 PRIOR ART
FIG. 2 is a sectional view of the main portion of the conventional coaxial starter motor.

FIG. 1 is a view illustrating the starter electric motor of one embodiment of the present invention. In this embodiment, the pinion 3 is mounted on the outer circumferential surface of the front end portion of the output rotary shaft 4 with a clearance for allowing slidable movement therebetween defined by the inner circumferential surface thereof. Further, a cylindrical portion 15 integrally extends from the rear end surface of the pinion 3. The cylindrical portion 15 has straight spline grooves 15*a* in its inner circumferential surface, and is spline-engaged with the strainght spline portion 4*c* of the output rotary shaft 4. Also, the outer circumferential surface of the cylindrical portion 15 is in contact with the inner circumferential surface of the support portion 9*f* formed at the front end portion of the clutch inner member 9*b*, and a return spring 10 is disposed between the rear end face of the support portion 9*f* in the space defined between the cylindrical portion 15 and the clutch inner member 9*b* and the front end portion of the helical spline portion 4*a* of the output rotary shaft 4. Further, a pinion spring 13 is disposed between the rear end of the cylindrical portion 15 and the front end of the helical spline portion 4*a* so as to forwardly bias the pinion 3 through the cylindrical portion 15. Also, a central support shaft 7*c* of the planetary speed reduction gear unit 7 is secured to the carrier 7*e*, and since this carrier 7*e* is locked against the clutch outer member 9*a* of the over-running clutch unit 9, the output of the planetary speed reduction gear unit 7 is transmitted to the over-running clutch unit 9. Reference numeral 16 is a solenoid switch disposed at the rear end of the d.c. electric motor 1. Since the arrangement is similar to that of the conventional design in other respect, the same reference characters are assigned to the corresponding components and their explanation will be omitted.

With the starter motor as above constructed, there is no conventional pinion spring 13 or spline engagement portion between the pinion 3 and the output rotary shaft 4 and they are in direct contact with each other, so that the deddendum diameter of the pinion 3 can be made small. For example, the number of teeth of the pinion 3 can be reduced, and it is possible that the pinion 3 can have six or seven teeth at the DP10 level, and seven or eight teeth at the DP12 level. Therefore, the starter motor can be made small in size and light in weight.

Further, the output rotary shaft 4 is supported at its front end portion by the pinion 3 and the support portion 9*f* of the clutch inner member 9*b* through the cylindrical portion 15 integral with the pinion 3, so that the clearance is small at the sliding portion between the output rotary shaft 4 and the clutch inner member 9*b*, and since the output rotary shaft 4 is supported at the front end position of the clutch inner member 9*b*, the distance between the support portion and the pinion 3 is small and the bending moment on the output rotary shaft 4 is small. Therefore, the chattering or the eccentricity of the output rotary shaft 4 when the pinion 3 is being brought into engagement with the engine ring gear is avoided.

In the above embodiment, since the engine starting operation is similar to that of the conventional design, its description will be omitted. Also, in FIG. 1, the upper half above the center line shows the stationary position and the lower half below the center line shows the operated position (when the shift of the pinion 3 is completed).

Also, while the pinion spring 13 is disposed behind the cylindrical portion 15 in the above embodiment, the spring 13 may equally be disposed within a space A defined within the cylindrical portion 15 between the rear end of the pinion 3 and the stepped portion of the output rotary shaft 4, whereby the advantageous results similar to those of the above embodiment can be obtained.

Further, while the support portion 9*f* of the clutch inner member 9*b* is arranged to directly slidably contact with the cylindrical portion 15, a metal sleeve may be inserted between the above components, thereby to improve the sliding of the cylindrical portion 15.

Also, the cylindrical portion 15 may not be made integral but may be made by a member separate from the pinion 3 and assembled later into a unitary structure.

Further, when the carrier 7*e* and the clutch outer member 9*a* are arranged so that they slip relative to each other upon a torque exceeding a predetermined value, the reliability can be much improved from the stand point of safety such as mechanical strength.

Also, while the above embodiment is a coaxial starter motor in which the solenoid switch unit 16 is disposed behind the d.c. electric motor 1, the present invention is not limited to this and is also applicable to the starter motor in which the solenoid switch unit and the electric motor are arranged side by side or the starter motor of the inertial sliding type having no solenoid switch unit. Also, while the starter motor having the planetary speed reduction gear 7 is described in the above embodiment, similar advantageous results can be obtained with the starter motor having no such speed reduction gear at all or another type of speed reduction gear.

As has been described, according to the present invention, the inner circumferential surface of the gear formed portion of the pinion is in sliding contact with the output rotary shaft and the cylindrical member integrally disposed to the pinion is urged into a sliding contact with the inner surface of the clutch inner member and the output rotary shaft is supported at the front portion of the clutch inner member through the pinion and the cylindrical member, so that the starter motor can be small in size and light in weight because the number of teeth can be reduced, and the clearance between the clutch inner member is small and the bending moment between the output rotary shaft is small, and the bending moment between the pinion and the support portion is also small, the generation of the noise and the breakage of the output rotary shaft can be prevented.

What is claimed is:

1. A starter motor, comprising: an over-running clutch unit (9) to which a drive force from an electric motor (1) is transmitted, an output rotary shaft (4) axially movably engaged through helical splines (4*a*, 9*d*) with an inner circumference of a clutch inner member (9*b*) at an output side of said over-running clutch, a pinion (3), mounted to a front portion of said output rotary shaft and engageable at an inner circumference of a gear portion thereof with an outer circumference of said output rotary shaft, for engaging and disengaging with a ring gear of an engine, and a cylindrical member (15) integrally disposed behind said pinion, having an outer circumferential surface slidably contacting an inner circumferential surface (9*f*) of said clutch inner member in front of a portion whereat said clutch inner member engages through the helical splines with the output rotary shaft, and having an inner circumferential surface in rotary drive force transmitting engagement with said output rotary shaft.

2. A starter motor according to claim 1, wherein the engagement between the cylindrical member and the output rotary shaft is implemented by splines (15*a*, 4*c*).

* * * * *